US007111447B2

(12) United States Patent
Rosenwasser

(10) Patent No.: US 7,111,447 B2
(45) Date of Patent: Sep. 26, 2006

(54) METHOD OF FORMING JEWELRY ARTICLES

(75) Inventor: Avraham Moshe Rosenwasser, 100 Rio Vista Dr., Norwood, NJ (US) 07648

(73) Assignee: Avraham Moshe Rosenwasser, Englewood Cliffs, NJ (US)

( * ) Notice: Subject to any disclaimer, the term of this patent is extended or adjusted under 35 U.S.C. 154(b) by 193 days.

(21) Appl. No.: 10/364,803

(22) Filed: Feb. 11, 2003

(65) Prior Publication Data

US 2004/0159088 A1 Aug. 19, 2004

(51) Int. Cl.
*A44C 27/00* (2006.01)

(52) U.S. Cl. ..... 59/35.1; 59/80; 29/896.41

(58) Field of Classification Search ..... 59/2, 59/35.1, 80; 29/896.41, 896.412, 896.43
See application file for complete search history.

(56) References Cited

U.S. PATENT DOCUMENTS

| | | | | | |
|---|---|---|---|---|---|
| 2,170,073 | A * | 8/1939 | Hess | 59/80 |
| 2,440,254 | A | 4/1948 | Dodson | |
| 2,518,163 | A * | 8/1950 | Megar | 59/80 |
| 2,528,185 | A * | 10/1950 | Speck | 59/80 |
| 3,025,820 | A * | 3/1962 | Rosenthal | 29/896.41 |
| 3,948,040 | A | 4/1976 | Tuppini | |
| 5,309,704 | A | 5/1994 | Grando | |
| 5,544,477 | A | 8/1996 | Rozenwasser | |
| 6,105,357 | A | 8/2000 | Weinberg | |
| 6,470,571 | B1 * | 10/2002 | Namiki | 29/896.41 |
| 2002/0166222 | A1 * | 11/2002 | Kojima et al. | 72/60 |

* cited by examiner

*Primary Examiner*—David Jones
(74) *Attorney, Agent, or Firm*—Katten Muchin Rosenman LLP

(57) ABSTRACT

A method of forming jewelry articles comprises the step of fabricating sheets of jewelry article halves, bringing such sheets together, fastening the articles halves together and separating the individual jewelry articles from the sheets by die punching or the like.

29 Claims, 3 Drawing Sheets

METHOD OF FORMING JEWELRY ARTICLES

FIELD OF THE INVENTION

The present invention relates to a method of forming jewelry articles, and more particularly, to an expeditious method of forming a plurality of jewelry articles by preparing sheets of jewelry article halves, attaching such sheets and the article halves at the same time and then separating the joined halves from the attached sheets.

BACKGROUND OF THE INVENTION

Typically with prior art jewelry articles such as, for example, links that form a jewelry chain, wherever the links are hollow in nature, each half of the link is punched or cut out individually and then the two parts of the link are joined together. By way of example, FIG. 1 illustrates a link 50 formed from two halves, namely an upper half 52 and a lower half 54. Each half 52, 54 is formed separately. Thereafter, some type of sealing material 60, such as solder or the like, is placed at the portions of the link 50 to be joined. The two halves 52, 54 are then typically held in place by means of a wire 62 or the like wound around the link 50. The link 50 is then placed in a furnace (not shown) with the wire 62 around it. After the solder 60 is hardened, the wrapping wire 62 holding the two link halves 52, 54 in place is removed and the final link 55 is thereby formed.

The aforementioned prior art process of individually forming each link is incredibly time consuming and labor intensive. Accordingly, the present inventors have devised a more efficient method of creating pluralities of jewelry articles without the labor intensive shortcomings of the prior art.

SUMMARY OF THE INVENTION

A method of forming jewelry articles comprises the step of fabricating two sheets of jewelry article halves, bringing such sheets together, fastening the jewelry article halves together and separating the individual jewelry articles from the sheets by die punching or the like. Thus, the basic concept is to form a plurality of jewelry articles at the same time through a two-sheet punching process, with each sheet forming a part of the resultant jewelry article, instead of fabricating each jewelry article individually.

DETAILED DESCRIPTION OF THE PREFERRED EMBODIMENTS

Figure 1:
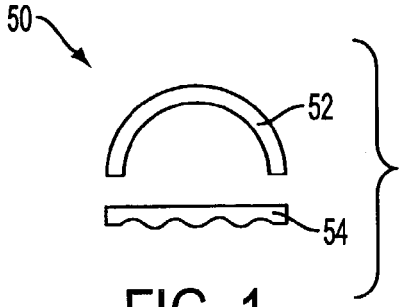
FIG. 1 (PRIOR ART)
FIGS. 1–3 represents a diagrammatic view of a prior art process of joining a pair of chain link halves to form a chain link.
Figure 2:
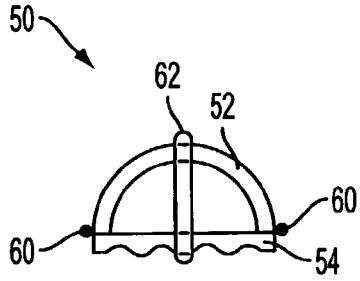
FIG. 2 (PRIOR ART)
Figure 3:
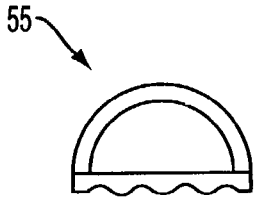
FIG. 3 (PRIOR ART)

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

For purposes of explanation, a jewelry article in the form of a jewelry chain link will be used to describe the inventive process, although it will be understood that other jewelry articles such as earrings, pins, rings and the like, may be formed from such process.

Figure 4:
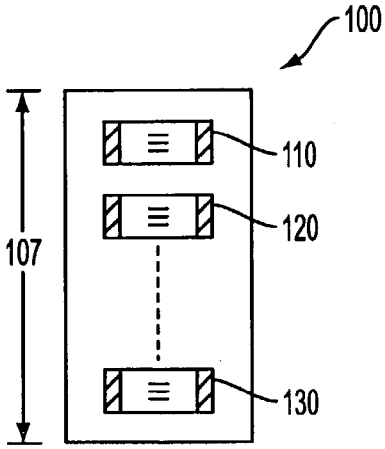
FIG. 4 is a front view of a sheet of material having jewelry article halves formed thereon and used in the method of the present invention.
Figure 5:
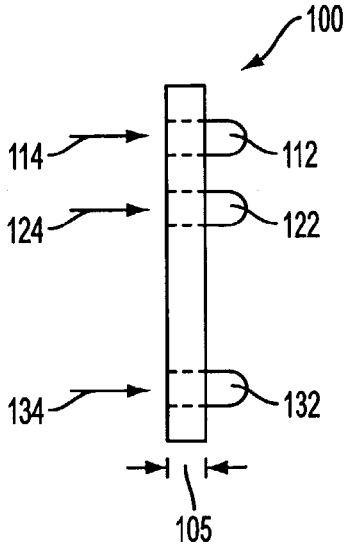
FIG. 5 is a side view of the sheet of FIG. 4.
Figure 17:
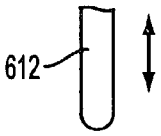
FIG. 17 illustrates a punch used in the method of the invention.
Figure 18:
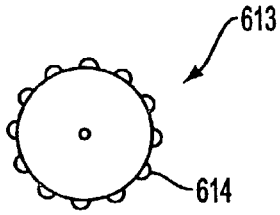
FIG. 18 illustrates a roller used in the method of the invention.

FIG. 4 is a front view and FIG. 5 is a side view of a sheet 100 of material having a thickness 105 and a plurality of jewelry article or chain link halves 110, 120 and 130 formed therein. Each chain link half 110, 120 and 130 has a portion 112, 122 and 132 that extends beyond the plane of the sheet 100. While three link halves are shown for purposes of illustration, it will be understood that any number of link halves may be formed on a single sheet 100, such number dependent on the length 107. The extended portions 112, 122, 132 are created by applying a force 114, 124, 134 to the side of the sheet 100, such force usually occurring in the form of a stamp, punch, roller or die (see FIGS. 17 and 18).

Figure 6:
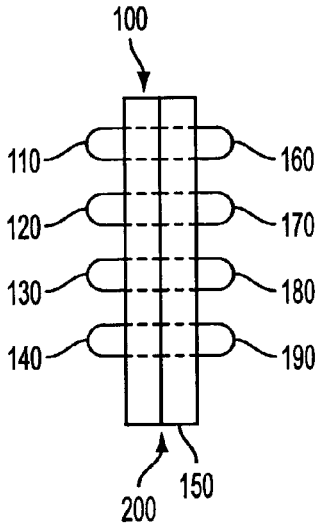
FIG. 6 illustrates the joinder of two sheets of material used in the method of the invention.
Figure 7:
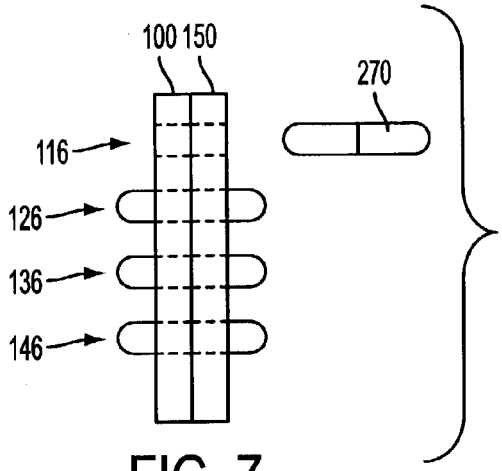
FIG. 7 illustrates the removal of completed jewelry articles from the joined sheets of FIG. 6.
Figure 16:
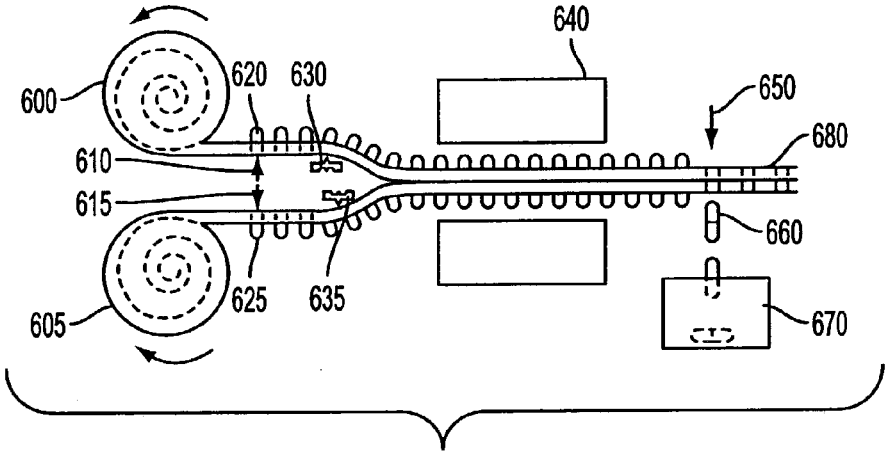
FIG. 16 illustrates one embodiment of a process for carrying out the method of the present invention.

FIG. 6 illustrates the adjacent, parallel positioning of two sheets 100, 150, each sheet having link halves 110–140 and 160–190 respectively formed therein. Just prior to the bringing of sheets 100, 150 together, epoxy or solder or some other adhesive material 200 is preferably put on the entire sheet including mating portions of the link halves to be joined. Alternatively, the adhesive material 200 can be applied only to the link halves to be joined. Alternatively, at least one of the sheets of material could be formed with a solder compound (not shown) inside, so that the exterior application of adhesive or solder to the sheets becomes unnecessary. Thereafter, the two sheets 100, 150 are brought together and clamped to each other and heated until the adhesive 200, solder, or the like cures (FIG. 7). Thereafter, a force 116, 126, 136, 146 is applied to the composite sheets 100+150 along each set of joined link halves until all of such joined link halves are removed from the composite sheets. Such force may be applied manually or in an automated process as shown in FIG. 16.

Figure 8:
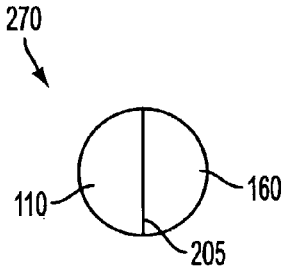
FIG. 8 illustrates a completed jewelry article formed from the method of the invention.

FIG. 8 is a front view of a joined link 270 removed from the composite sheets 100+150 illustrated in FIG. 7. Such link 270 is formed from link halves 110 and 160 and has a seam line 205 representative of where the link halves 110, 160 were joined by adhesive 200 (FIG. 6). Such link 270 may then be incorporated into a jewelry chain, or made into earrings, a pin or the like with the attachment of a clasp (not shown) or the like.

Figure 9:
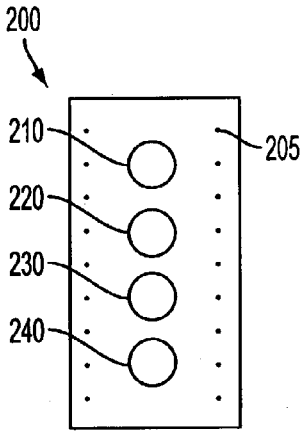
FIG. 9 illustrates an alternative embodiment of a sheet of material used in the method of the invention.
Figure 10:
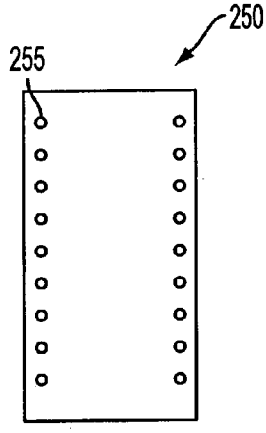
FIG. 10 illustrates an alternative embodiment of a sheet of material used in the method of the invention.
Figure 11:
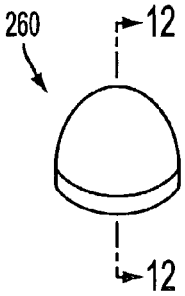
FIGS. 11 and 12 illustrates a jewelry article formed in accordance with the method of the invention.
Figure 12:
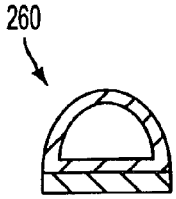

Various article shapes and designs may be formed using the method of the present invention. For example, a sheet 200 (FIG. 9) having hemispherical link halves 210–240 imparted thereto may be joined with a plain sheet 250 (FIG. 10) to form joined links (260 for example) as shown in FIGS. 11 and 12. In the hollow link 260, one half is curved while the other half is planar. FIGS. 9 and 10 also illustrate that the sheets can be formed with guiding means to assist in the joinder and clamping together of the sheets during attachment of the jewelry article halves. For example, sheet 200 of FIG. 9 is fitted with a series of pins 205 that fit into the series of holes 255 provided on sheet 250 of FIG. 10. Such pins 205 and slots 255 insure a proper alignment of the sheets 200, 250 during clamping of the sheets together and prior to separating the combined jewelry article halves from such sheets.

Figure 20:
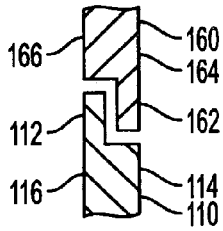
FIG. 20 illustrates one type of guiding means used in the method of the invention.

It should be appreciated that other guiding means could be provided on the sheets to maintain proper alignment of the sheets, and thus the jewelry article halves. As another example, jewelry article halves 110 and 160 (FIGS. 4–8) could be created with lips 112, 162 (FIG. 20) that interlock during the attachment of the sheets 100, 150 (FIGS. 4–7) to facilitate the joinder of the halves 110, 160. If the article halves 110, 160 are created by punching, then the lips 112, 162 could be created by punching the inner walls 116, 166 of the article halves 110, 160 at a different depth than the outer walls 114, 164 (FIG. 20). Alternatively, only one of the articles halves could be provided with a lip that overhangs the other article half during joinder of the two (not shown). Other means of facilitating the joinder of the sheets or the article halves are contemplated.

Figure 13:
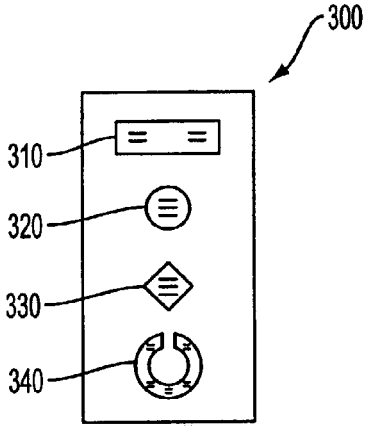
FIGS. 13–15 illustrate alternative embodiments of sheets of material used in the method of the invention.

FIG. 13 illustrates that the method of the present invention is not limited to the creation of only one type of link or jewelry article per sheet. For example, a sheet 300 may be formed with a plurality of different article halves 310–340, which are joined with other articles halves (not shown) to form a plurality of different shaped jewelry articles. Jewelry articles may be formed in any shape, size, cross-section or contour.

Figure 14:
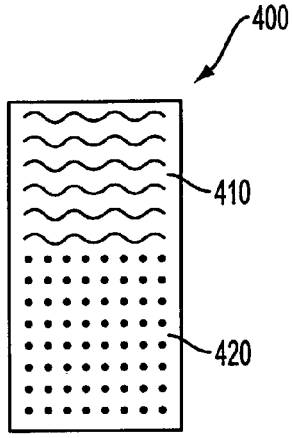
Figure 15:
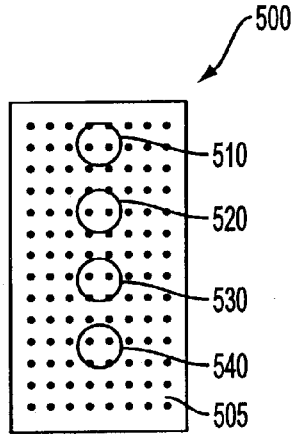

FIG. 14 illustrates a sheet 400 provided, for example, with a plurality of different contours 410, 420, which when combined with a sheet having link halves formed therein, result in a combined link having one half with a textured appearance. Thus, in the example of FIGS. 9–12, the sheet of FIG. 10 could be replaced with the sheet of FIG. 14 to produce links 260 having a textured planar bottom half. Alternatively as shown in FIG. 15, a texture or contour 505 could be applied to a sheet 500 prior to imparting link half impressions 510–540 thereto, resulting in textured link halves 510–540. Such texture or contour can be applied to one or both link halves as desired by the manufacture.

Figure 19:
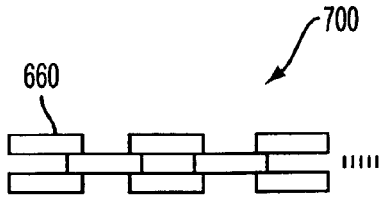
FIG. 19 is a top view of a chain section created from links formed in accordance with the method of the invention.

FIG. 16 illustrates one example of a process for implementing the method of the present invention, it being understood that other processes are contemplated. Two rolls of sheet material 600, 605 are conveyed passed means for creating link halves 620, 625. Such means may be in the form of a reciprocating punch 612 (FIG. 17), a roller 613 (FIG. 18) having shaping means 614 formed thereon, or the like. An adhesive means 630, 635 is then applied to the underside of the sheets and then the sheets are brought together and clamped to join the link halves 620, 625. Alternatively, as noted above, a solder compound (not shown) may be embedded in the sheet material, in which case the adhesive means 630, 635 would be rendered unnecessary. Joinder or guiding means such as the pin/hole (205, 255) arrangement illustrated in FIGS. 9 and 10 may be employed to facilitate the joinder of the sheets 600, 605. If the adhesive 630, 635 is heat curable, or if a solder compound is employed in the sheets 600, 605, the joined sheets are then subjected to curing means 640, such as a heater or the like. The joined sheets and joined link halves are then subjected to removing means 650 (such as a reciprocating punch or roller—see FIGS. 17 and 18) for forcing the joined links 660 from the joined sheets. Such joined links 660 are then collected in a container 670 or the like and assembled into items of jewelry 700 (FIG. 19) such as a chain or the like. The remaining sheet material 680 is then salvaged and reused. Again, FIG. 16 illustrates one possible process for creating a plurality of jewelry articles, it being understood that other processes and methods are contemplated.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

I claim:

1. A method of forming jewelry articles comprising the steps of:

a) forming a first sheet of a first plurality of jewelry article halves, b) forming a second sheet of a second plurality of jewelry article halves, c) attaching said first and second sheets together so that said first and second pluralities of jewelry article halves meet, d) securing said first and second pluralities of jewelry article halves to each other, and e) separating said plurality of secured jewelry article halves from said first and second sheets to form a plurality of jewelry articles.

2. A method in accordance with claim 1, wherein said securing further comprises the soldering of said first and second pluralities of jewelry article halves to each other to form a plurality of jewelry articles.

3. A method in accordance with claim 1, wherein said separating further comprises the punching of said plurality of jewelry articles through said first and second sheets.

4. A method in accordance with claim 3, wherein said punching occurs by the application of a force normal to one of the first and second sheets.

5. A method in accordance with claim 1, wherein each jewelry article half from one of said first and second pluralities of jewelry article halves has the same appearance.

6. A method in accordance with claim 1, wherein at least two jewelry article halves from one of said first and second pluralities of jewelry article halves have a different appearance.

7. A method in accordance with claim 1, wherein as least one of said first and second sheets is uncontoured such that at least one of said first and second jewelry articles halves is planar.

8. A method in accordance with claim 1, wherein each half of said first and second pluralities of jewelry articles halves has the same shape.

9. A method in accordance with claim 1, wherein at least one jewelry article half on at least one of said first and second sheets has a concave contour.

10. A method in accordance with claim 1, wherein said plurality of jewelry articles are hallow.

11. A method in accordance with claim 1, wherein said securing of said first and second pluralities of jewelry article halves so each other comprises she securing of said first and second sheets together.

12. A method in accordance with claim 1, wherein said first and second sheets are secured together with an adhesive.

13. A method in accordance with claim 1, wherein said first and second sheets are secured together wish an epoxy.

14. A method in accordance with claim 12, wherein said first and second sheets are secured together with solder.

15. A method in accordance with claim 13, wherein said first and second sheets are heated after being secured.

16. A method in accordance with claim 1, wherein said first and second sheets extend along parallel planes and are secured together in parallel.

17. A method in accordance with claim 1, wherein said forming of one of said first and second pluralities of jewelry article halves further comprises the step of stamping contours onto said respective first or second sheet.

18. A method in accordance with claim 1, wherein said forming of one of said first and second pluralities of jewelry article halves further comprises the step of rolling contours onto said respective first or second sheet.

19. A method in accordance with claim 1, wherein said first and second sheets are formed on first and second rolls prior to being attached.

20. A method in accordance with claim 1, wherein at least one of said first and second sheets are provided with solder compound.

21. A method in accordance with claim 1, wherein said first and second sheets are provided with guiding means that assist in the attaching of said first and second sheets together.

22. A method in accordance with claim 21, wherein said guiding means further comprises a pin formed on one sheet that engages with an opening formed on the other sheet.

23. A method in accordance with claim 21, wherein said guiding means further comprises the formation of interlocking edges on said pluralities of jewelry article halves.

24. A method in accordance with claim 1, further comprising the step of assembling said plurality of jewelry articles into a wearable form.

25. A method of forming jewelry articles comprising the steps of:

a) forming a first sheet of a plurality of jewelry article portions, b) forming a second sheet, c) attaching said first and second sheets together and securing said plurality of jewelry article portions with said second sheet to form a plurality of jewelry articles, and d) separating said plurality of jewelry articles from said first and second sheets.

26. A method in accordance with claim 25, wherein said second sheet is uncontoured.

27. A method in accordance with claim 25, wherein said second sheet is provided with a plurality of second jewelry article portions that mate with said jewelry article portions provided on said first sheet.

28. A method in accordance with claim 25, wherein said first and second sheets are secured by soldering.

29. A method in accordance with claim 25, wherein soldering compound embedded in one of said first and second sheets is used to secure said sheets together.

* * * * *